US009207618B2

(12) United States Patent
Izawa et al.

(10) Patent No.: US 9,207,618 B2
(45) Date of Patent: Dec. 8, 2015

(54) ELECTROPHOTOGRAPHIC SHEET-FED FRONT/BACK PRINTING MACHINE

(71) Applicants: Hideo Izawa, Narashino (JP); Junichi Setoyama, Narashino (JP); Kenji Takahashi, Narashino (JP)

(72) Inventors: Hideo Izawa, Narashino (JP); Junichi Setoyama, Narashino (JP); Kenji Takahashi, Narashino (JP)

(73) Assignee: MIYAKOSHI PRINTING MACHINERY CO., LTD., Narashino-Shi, Chiba (JP)

( * ) Notice: Subject to any disclaimer, the term of this patent is extended or adjusted under 35 U.S.C. 154(b) by 0 days.

(21) Appl. No.: 14/302,232

(22) Filed: Jun. 11, 2014

(65) Prior Publication Data

US 2015/0003882 A1 Jan. 1, 2015

(30) Foreign Application Priority Data

Jun. 28, 2013 (JP) ..... 2013-136450

(51) Int. Cl.

| | |
|---|---|
| ***G03G 15/00*** | (2006.01) |
| ***G03G 15/23*** | (2006.01) |
| ***B65H 85/00*** | (2006.01) |
| ***G03G 15/01*** | (2006.01) |

(52) U.S. Cl.

CPC ..... *G03G 15/6529* (2013.01); *G03G 15/0189* (2013.01); *G03G 15/234* (2013.01); *G03G 15/6558* (2013.01)

(58) Field of Classification Search

CPC . G03G 15/00; G03G 15/234; G03G 15/6529; G03G 15/6558; G03G 15/0189; G05G 15/23; B65H 85/00

USPC ..... 399/361, 363, 364, 381, 401

See application file for complete search history.

(56) References Cited

U.S. PATENT DOCUMENTS

| | | | | |
|---|---|---|---|---|
| 4,431,303 | A | 2/1984 | Hoffman | |
| 4,466,607 | A * | 8/1984 | Clark et al. | 271/225 |
| 4,924,275 | A * | 5/1990 | Nelson | 399/401 |
| 5,729,819 | A * | 3/1998 | Maekawa et al. | 399/401 |
| 5,815,788 | A * | 9/1998 | In't Zandt | 399/400 |
| 6,571,706 | B1 | 6/2003 | Conzelmann et al. | |

(Continued)

FOREIGN PATENT DOCUMENTS

| | | |
|---|---|---|
| EP | 0078717 A2 | 5/1983 |
| EP | 0636951 A2 | 2/1995 |

(Continued)

OTHER PUBLICATIONS

Extended European Search Report dated Sep. 30, 2014 issued in counterpart European Application No. 14174008.4.

*Primary Examiner* — Nguyen Ha

(74) *Attorney, Agent, or Firm* — Holtz, Holtz, Goodman & Chick PC

(57) ABSTRACT

In an electrophotographic sheet-fed front/back printing machine which is capable of duplex printing and which can be installed in a reduced space, sheets of paper fed from a sheet supply are fed out by a sheet transport conveyer onto an impression cylinder of an electrophotographic printing section in which each of the sheets are printed on one side. The sheets printed on one side are turned over from front to back by a sheet turnover transport unit and are allowed to fall and be supplied onto the sheet transport conveyer. The sheets are each fed again onto the impression cylinder and printed on the remaining other side. Sheets printed on both sides are transported by a printed-sheet transport unit to a print output receptacle in which they are received.

9 Claims, 9 Drawing Sheets

(56) References Cited

U.S. PATENT DOCUMENTS

| | | | | |
|---|---|---|---|---|
| 6,834,167 | B2 * | 12/2004 | Tomizawa et al. | 399/44 |
| 8,977,184 | B2 * | 3/2015 | Tokuda et al. | 399/364 |
| 2001/0028819 | A1 * | 10/2001 | Okamoto | 399/401 |
| 2001/0031161 | A1 * | 10/2001 | Nakazato | 399/388 |
| 2006/0216091 | A1 | 9/2006 | Terashima | |
| 2006/0239733 | A1 * | 10/2006 | Choi et al. | 399/396 |
| 2012/0128395 | A1 | 5/2012 | Izawa et al. | |
| 2013/0081167 | P1 * | 3/2013 | Schoone | |

FOREIGN PATENT DOCUMENTS

| | | | | | |
|---|---|---|---|---|---|
| JP | 56111864 | A | * | 9/1981 | G03G 15/00 |
| JP | 57125948 | A | * | 8/1982 | G03G 15/00 |
| JP | 58007656 | A | * | 1/1983 | G03G 15/00 |
| JP | 58082268 | A | * | 5/1983 | G03G 15/00 |
| JP | 58125052 | A | * | 7/1983 | G03G 15/00 |
| JP | 08012203 | A | * | 1/1996 | B65H 85/00 |
| JP | 09015911 | A | * | 1/1997 | G03G 15/00 |
| JP | 11277718 | A | | 10/1999 | |
| JP | 2012068375 | A | | 4/2012 | |

* cited by examiner

Fig. 3

V1, V2: Peripheral speed of Impression cylinder
V min: Minimum speed of Sheet transport conveyer
V max 1, V max 2: Maximum speed of Sheet transport conveyer according to Peripheral speed (V1, V2) of Impression cylinder

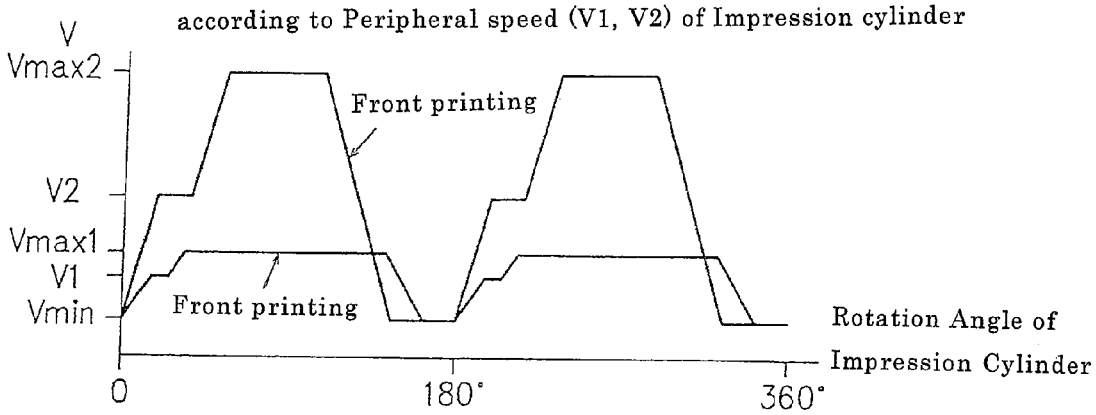

Fig. 4

V1: Peripheral speed of Impression cylinder
V min: Minimum speed of Sheet transport conveyer
V max 1, V max 3: Maximum speed of Sheet transport conveyer according to Peripheral speed (V1) of Impression cylinder

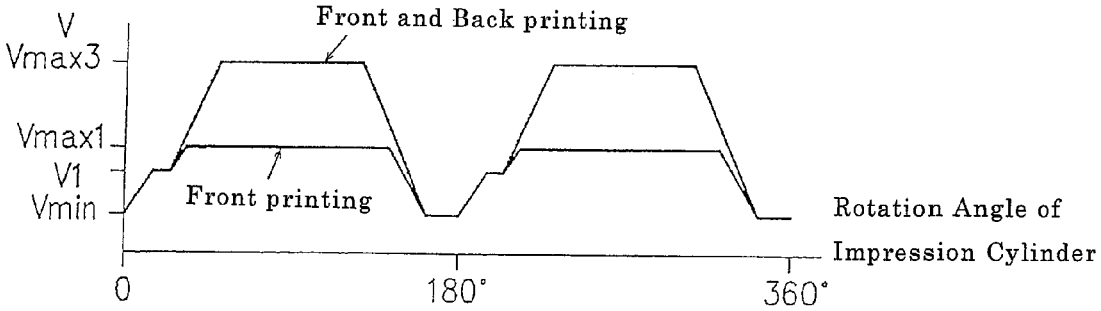

ELECTROPHOTOGRAPHIC SHEET-FED FRONT/BACK PRINTING MACHINE

TECHNICAL FIELD

The present invention relates to an electrophotographic printer using a liquid toner and, in particular, to an electrophotographic sheet-fed front/back (duplex) printing machine for printing a sheet of paper on its front and back sides in a single color or in a plurality of colors.

BACKGROUND ART

A sheet-fed rotary press printer for printing a sheet of paper on its front and back sides in a plurality of colors is disclosed in JP H11-277718 A.

In this printing machine, a plurality of first printing units is succeeded by a plurality of second printing units via a turnover unit so that a sheet of paper may be printed on its front side in colors by the first printing units, be turned over and be printed on its back side in colors by the second printing units.

An electrophotographic printer for printing a sheet of paper on its front and back sides is disclosed in JP 2012-068375 A.

In this printing machine, a first and a second impression cylinder are brought into rotational contact with each other and have a first and a second transfer roller of an electrophotographic printing unit brought into rotational contact therewith, respectively. A sheet of paper is passed through a region of rotational contact between the first impression cylinder and transfer roller to print on the front side and is passed through a region of rotational contact between the second impression cylinder and transfer roller to print on the back side.

The former printing machine as it needs to be equipped with the first and second printing units requires a large area on which it is installed, and increase the cost of equipment.

Especially for multicolor printing, the need for a plurality of the first printing units and a plurality of the second printing units requires larger area of the installation and further increases the equipment cost.

The latter printing machine needed to include the first and second impression cylinders requires an increased area of its installation.

Made to solve the problems mentioned above, the present invention seeks to provide an electrophotographic sheet-fed front and back printing machine which is capable of printing a sheet of paper on its front and back sides and which can be installed in a reduced space.

DISCLOSURE OF THE INVENTION

The present invention provides an electrophotographic sheet-fed front/back printing machine having a sheet supply, a sheet transport conveyer, an electrophotographic printing section, a printed-sheet transport unit and a print output section arranged in order from upstream to downstream in a direction of transport of sheets of paper, and having a sheet turnover transport unit disposed upwards of the sheet transport conveyer, characterized by:

the sheet supply feeding out sheets one by one onto the sheet transport conveyer, the sheet transport conveyer feeding out sheets onto an impression cylinder in the electrophotographic printing section, the electrophotographic printing section comprising an electrophotographic printing unit including a photoconductor drum, a transfer roller and the impression cylinder whereby a toner image formed on the photoconductor drum is transferred onto the transfer roller and the toner image on the transfer roller is transferred and printed onto a sheet on the impression cylinder, the printed-sheet transport unit receiving printed sheets delivered from the impression cylinder for transporting the printed sheets to the print output section, and the sheet turnover transport unit receiving a printed sheet delivered from the impression cylinder for turning over the printed sheet from front to back and allowing it to fall and to be supplied onto the sheet transport conveyer; and comprising a sheet delivery means for selectively delivering a printed sheet from the impression cylinder to one of the printed-sheet transport unit and the sheet turnover transport unit.

In the electrophotographic sheet-fed front/back printing machine of the present invention more specifically, the sheet transport conveyer is provided on its sheet feed-out side with a sheet positioner for positioning a sheet longitudinally and crosswise and a sheet feed-out means for feeding out the so positioned sheet onto the impression cylinder, and the sheet transport conveyer has a traveling speed so controlled to follow a peripheral speed of the impression cylinder that it is slower than the peripheral speed of the impression cylinder when the sheet is positioned as aforesaid and that it is faster than the peripheral speed of the impression cylinder while the sheet is in transport.

This permits a sheet positioned longitudinally and crosswise to be fed out onto the impression cylinder.

Also, a sheet which when positioned is slower in its speed of transport than on the impression cylinder can easily be positioned. And, transporting the sheet while in transport at a speed higher than the speed of the impression cylinder allows feeding out the sheet onto the impression cylinder in matched timing with a rotation of the impression cylinder.

In the electrophotographic sheet-fed front/back printing machine of the present invention more specifically, the sheet supply is operable to repeat an operation of feeding out a plurality of sheets successively and interrupting feeding the sheets out, and the sheet delivery means has a first state of delivering a printed sheet onto the sheet turnover transport unit in which a plurality of sheets fed out of the sheet supply are printed each on its one side, and a second state of delivering a printed sheet to the printed-sheet transport unit, the second state being taken by the sheet delivery means when a first of the sheets printed each on its one side and fed onto the impression cylinder is printed on its other side also, the sheet delivery means resuming the first state when a last of the sheets fed out of the sheet supply and each having its both sides printed is delivered to the printed-sheet transport unit.

This allows performing duplex printing efficiently.

In the electrophotographic sheet-fed front/back printing machine of the present invention more specifically, the sheet transport conveyer has a length of sheet transport such that a sheet positioned closer to and fed out onto the impression cylinder and a sheet falling and supplied from the sheet turnover transport unit and closer to the sheet supply may not overlap with each other, and the sheet turnover transport unit has a path of transport in which a printed sheet delivered from the impression cylinder is transported towards the sheet supply, the path having a sheet falling region in which the printed sheet transported is allowed to fall on the sheet transport conveyer and closer to the sheet supply.

This prevents a one-side printed sheet falling and supplied from the sheet turnover transport unit from overlapping with a sheet on the sheet transport conveyer to be fed out onto the impression cylinder, ensuring their duplex printing.

In the electrophotographic sheet-fed front/back printing machine of the present invention more specifically, the impression cylinder is sized to double the photoconductor drum and can have two sheets set thereon so that one of the two sheets set may come into contact with the transfer roller and the other sheet may then come into contact with a transfer cylinder for the printed-sheet transport unit and with a return intermediate cylinder in the sheet turnover transport unit, respectively.

This permits a printed sheet from the impression cylinder to be delivered selectively onto one of the printed-sheet transport unit and the return intermediate cylinder of sheet turnover transport unit.

According to the present invention, it is possible to selectively perform simplex and duplex printing of sheets.

In duplex printing, a sheet having one side printed is turned over from front to back and is fed back to the impression cylinder where it is printed on the other and remaining side. This makes it unnecessary to have recourse to two printing units for printing on front side and for printing on back side, respectively, and to increase the area for installation therefor. A substantial reduction in cost of equipment is also achieved.

It is unnecessary to reset one-side printed sheets in the sheet supply, thereby reducing the time period for duplex printing.

Also, by permitting a sheet printed on one side to fall from the sheet turnover transport unit onto the sheet transport conveyer and the sheet to be transported by the sheet transport conveyer again onto the impression cylinder and printed on the other side, thus having both sides printed, the sheet printed on the one side is prevented from breaking or bending to damage.

BRIEF DESCRIPTION OF THE DRAWINGS

In the Drawings:

FIG. 3 is a graphic chart of the speed of the paper transport conveyer;

FIG. 4 is another graphic chart of the speed of the paper transport conveyer;

BEST MODES FOR CARRYING OUT THE INVENTION

Figure 1:
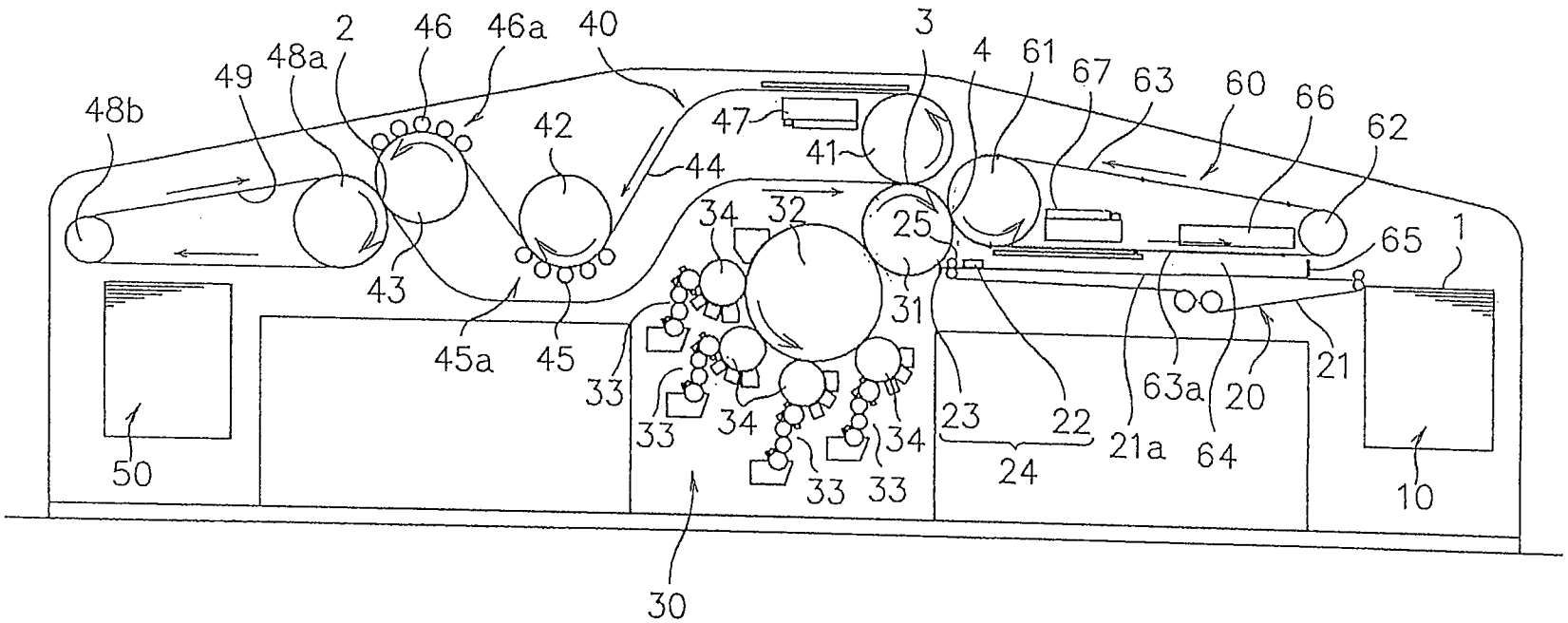
FIG. 1 is an overall makeup explanatory view that illustrates an electrophotographic sheet-fed front and back printing machine as a form of implementation of the present invention.

FIG. 1 is an overall makeup explanatory view illustrating one form of implementation of the electrophotographic sheet-fed front and back printing machine for printing a sheet of paper (a term that may herein be referred to simply as a sheet) on its front and back sides. The machine is designed to operate in a multicolor printing satellite system corresponding to four colors of Y (yellow), M (magenta or red), C (cyan or blue) and B (black) to print on both sides of the sheet in the colors.

Both sides of a sheet can be multicolor-printed on in different images on its front and back sides.

The machine has a sheet supply 10, a sheet transport conveyer 20, an electrophotographic printing section 30, a printed-sheet transport unit 40 and a print output section or receptacle 50, provided in order from upstream to downstream in the direction of transport of sheets. And, a turnover transport unit 60 is provided upwards of the sheet transport conveyer 20.

From the sheet supply 10, sheets of paper 1 are supplied (fed out) one by one onto the sheet transport conveyer 20 by such as a feed belt or feed rollers (not shown or indicated).

In this form of implementation to print on both sides of a sheet 1, a selected number of successive sheets 1, e.g. six successive sheets 1, are continuously, then intermittently, fed out of and supplied from the sheet supply 10 onto the sheet transport conveyer 20.

The sheet transport conveyer 20 has an endless belt 21 wound over a plurality of rollers any of which can be driven to rotate by a motor to cause the endless belt 21 to travel.

The sheet transport conveyer 20 is provided on its feed-out side with a sheet positioner 24 having a crosswise and a front stopper 22 and 23 for positioning sheets 1 crosswise and longitudinally, respectively, the positioner 24 positioning them in a crosswise and a longitudinal direction.

The sheet transport conveyer 20 is provided on its feed-out side with a sheet feed-out means for feeding out each positioned sheet onto an impression cylinder 31.

For example, the endless belt 21 is provided closer to the impression cylinder 31 with a press roller 25 movable vertically into pressure contact with and away from an upper part 21*a* of the endless belt 21 to constitute the sheet feed-out means for feeding out the positioned sheet onto the impression cylinder 31.

The electrophotographic printing section 30 includes the impression cylinder 31, a transfer roller 32 in contact with the impression cylinder 31, and electrophotographic printing units 33, e.g. four electrophotographic printing units 33, disposed around the transfer roller 32.

An electrophotographic printing unit 33 is here an electrophotographic simplex (one-side) printing unit in which an electrostatic latent image based on image data is formed on a photoconductor drum 34 and a liquid toner is attached to the electrostatic latent image to form a toner image that is transferred to the transfer roller 32.

And, the toner image transferred onto the transfer roller 32 is transferred onto (printed on) a sheet 1 in an area in which it is brought into contact with the impression cylinder 31.

The diameter of the impression cylinder 31 is twice the diameter of the photoconductor drum 34, so the impression cylinder 31 can carry two sheets 1 wound around it.

Also, a periodic deviation in transfer position due to a processing strain and an assembly error for each photoconductor drum 34 (as encountered when multicolor printing is effected on a sheet with the impression cylinder 31) can be easily compensated for.

The diameter of the impression cylinder 31 need not be limited to twice the diameter of the photoconductor drum 34; it may be a two or more integer time of the diameter of the photoconductor drum 34 so that two or more sheets 1 can be wound around the impression cylinder 31.

The printed-sheet transport unit 40 comprises a first chain 44 wound over a sprocket (not shown) provided coaxial with a transfer cylinder 41 disposed adjacent to the impression cylinder 31, an intermediate sprocket (not shown) provided coaxial with an intermediate cylinder 42 and a sprocket provided coaxial with a terminal cylinder 43. The first chain 44 has a sheet gripper (not shown) for gripping a sheet of paper 1. Any of these sprockets can be driven to rotate by a motor to drive the first chain 44 to travel and thereby to transport sheets of paper 1.

Along a lower peripheral surface of the intermediate cylinder 42 there are arranged a plurality of first fixing rollers 45 to constitute a first fixing zone 45*a*. Along an upper peripheral surface of the terminal cylinder 43 there are arranged a plurality of second fixing rollers 46 to constitute a second fixing zone 46*a*.

And, a toner image printed on the lower side of a sheet transported by the first chain 44*n* is fixed in the first fixing zone 45*a*, and a toner image printed on the upper side of the sheet is fixed in the second fixing zone 46*a*.

Between the transfer cylinder 41 and the intermediate cylinder 42 there is provided a heating heater 47 such as IR heater. This heating heater 47 is provided to preliminarily heat (tentatively fix) the lower side of a printed sheet of paper whereafter the toner image is heat-fixed (primarily fixed) in the first fixing zone 45*a*.

The printed-sheet transport unit 40 also includes a second chain 49 wound over a first sprocket (not shown) provided coaxial with a first cylinder 48*a* disposed adjacent with the terminal cylinder 43 and a second sprocket (not shown) provided coaxial with a second cylinder 48*b*. The second chain 49 has a sheet gripper (not shown) for griping a sheet of paper 1. The first or second sprocket may be driven to rotate by a motor to transport the sheet of paper with the second chain 49.

A delivery means is provided in a sheet delivery region 2 where the terminal cylinder 43 is in contact with the first cylinder 48*a*.

The delivery means not shown may use such as a cam member for actuating the first sheet gripper provided for the first chain 44 to release a sheet and then actuating the second gripper provided for the second chain 49 to grip the sheet.

This being the case, a printed sheet of paper 1 gripped by the first sheet gripper of the first chain 44 and transported to the delivery region 2 is released by the delivery means from gripping by the first sheet gripper for the first chain 44 and is gripped by the second sheet gripper for the second chain 49 and thereby delivered onto the second chain 49.

And, such printed sheets of paper 1 are transported to a region above the print output receptacle 50 and are received one by one into the print output receptacle 50 upon each being released from gripping by the sheet gripper for the second chain 49.

This allows the printed sheets to be received, piled one by one, into the print output receptacle 50.

The sheet turnover transport unit 60 is provided to turn over (from front to back) a sheet having one side printed and to deliver the sheet turned over onto the sheet transport conveyer 20 for re-transport by the sheet transport conveyer 20 into the electrophotographic printing section 30 (onto the impression cylinder 31) in which to print on the unprinted side and to have both sides printed on.

The sheet turnover transport unit 60 has a chain 63 wound over a sprocket (not shown) mounted coaxial with a return intermediate cylinder 61 adjacent to the impression cylinder 31 and a sprocket (not shown) mounted coaxial with a terminal cylinder 62. The chain 63 is endless and provided with grippers (not shown) for gripping sheets of paper 1.

The chain 63 has a lower part 63*a* extending horizontally between the lowest parts of the return intermediate and terminal cylinders 61 and 62 and moving from the side of the impression cylinder 31 towards the sheet supply 10.

The endless belt 21 of the sheet transport conveyer 20 has an upper part 21*a* transporting a sheet of paper 1 towards the impression cylinder 31 and extending parallel to the lower part 63*a* of the chain 63, the part 21*a* and the part 63*a* being vertically spaced apart from and opposed to each other.

The lower part 63*a* of the chain 63 has a portion that is closer to the sheet supply 10 and that constitutes a sheet falling region 64 from which a sheet once transported towards the impression cylinder 31, having one side printed on and then turned over from front to back is allowed to fall and to be supplied onto the upper part 21*a* of the endless belt 21.

The sheet falling region 64 is provided at its downstream side (i.e. the side of the sheet supply 10) with a sheet stopper 65. And, a sheet releasing mechanism 66 is disposed inside of the chain 63 and opposed to the sheet falling region 64 in the lower part 63*a* of the chain 63.

The sheet releasing mechanism 66 which may use a cam or the like to release grip of a sheet by the sheet gripper of the chain 63 extends to cover a total length of the sheet falling area 64 in the sheet transport direction.

Above the lower part 63*a* of the chain 63 there is provided a heating heater 67 such as IR heater. This heating heater 67 is provided to preliminarily heat (tentatively fix) an upper surface of the one-side printed sheet traveling along the lower part 63*a* of the chain 63.

A region where the impression cylinder 31 and the transfer cylinder 41 come in contact with each other constitutes a first sheet delivery region 3 and is provided with a first sheet delivery means (not shown).

A region where the impression cylinder 31 and the return intermediate cylinder 61 come into contact with each other constitutes a second sheet delivery region 4 and is provided with a second sheet delivery means (not shown).

Actuating the first delivery means while deactivating the second delivery means delivers a printed sheet from the impression cylinder 31 onto the transfer cylinder 41.

Actuating the second delivery means while deactivating the first delivery means delivers a printed sheet from the impression cylinder 31 onto the return intermediate cylinder 61.

The first delivery means may, for example, be a cam switching unit that acts to release gripping, and to grip, a sheet with a sheet gripper on the impression cylinder 31 and a sheet gripper on the first chain 44 so that when the sheet gripper gripping the sheet on the impression cylinder 31 reaches the first sheet delivery region 3, it may act to release gripping the sheet and the gripper on the first chain 44 may then be operated to grip the sheet, gripping the sheet to accept and deliver the sheet onto the transfer cylinder 41.

The second delivery mans may, for example, be cam switching unit that acts to release gripping, and to grip, a sheet with the sheet gripper on the impression cylinder 31 and a sheet gripper on the return intermediate cylinder 61 so that when the sheet gripper gripping the sheet on the impression cylinder 31 reaches the second sheet delivery region 4, it may act to release gripping the sheet, releasing grip of the sheet, and the gripper on the return intermediate cylinder 61 may then be operated to grip the sheet, gripping the sheet to accept and deliver the sheet onto the intermediate cylinder 61.

The first and second delivery means may neither be limited to a cam switching unit and may meet with a mechanism that supports and transports sheets.

Mention is next made of a printing operation.

In the case of printing sheets each on its one side only:

Sheets of paper are fed out successively one by one from the sheet supply 10 and transported so on the sheet transport conveyer 20 towards the impression cylinder 31.

A sheet transported is positioned by the sheet positioner 24 transversely and longitudinally. Then, the press roller 25 has been moved upwards and spaced apart from the upper part 21*a* of the endless belt 21.

When sheet positioning is accomplished, the press roller 25 is moved down and brought into pressure contact with the upper part 21*a* of the endless belt 21. The sheet positioned is fed out onto the impression cylinder 31 so that a toner image on the transfer roller 32 is transferred onto the lower side of the sheet on the impression cylinder 31.

Sheets onto which such toner images are transferred, i.e. those printed each on its one side, are delivered from the first sheet delivery region 3 onto the transfer cylinder 41 and transported by the first and second chains 44 and 49 to the print output receptacle 50.

Then, a toner image on the lower face of a sheet is preliminarily heated by the heating heater 47 and fixed in the first fixing zone 45*a*. Note then that the second fixing zone is held deactivated.

In the case of printing sheets on both sides:

A sheet as in the casing of printing on one side is printed on its lower side and the sheet printed on the side is delivered from the second delivery region 4 onto the return intermediate cylinder 61 with the printed side facing upwards.

The sheet printed on the one side is transported by the chain 63, and its upper side (printed side) is preliminarily heated by the heating heater 67. The sheet having the one side printed on is then caused by the sheet releasing mechanism 66 to leave the chain 63 and allowed to fall from the sheet falling region 64 on, and thereby be supplied onto, the upper part 21*a* of the endless belt 21 in the sheet transport conveyer 20.

The sheet printed on the one side and falling on and supplied onto the upper part 21*a* of the endless belt 21 is transported by the endless belt 21 and positioned by the sheet positioner 24 as mentioned previously. The sheet positioned is fed out onto the impression cylinder 31 by both the press roller 25 and the endless belt 21.

The sheet printed on the one side and fed onto the impression cylinder 31 has a toner image printed on the other side, becoming a sheet printed on both sides.

The sheet printed on both sides is delivered through the first sheet delivery region 3 onto the transfer cylinder 41, Such printed sheets with their lower faces preliminarily heated by the heating heater 47 are successively transported by the first and second chains 44 and 49 to the print output receptacle 50 in which they are received, being laid one on top of another.

In this stage, the toner image printed on the lower face of each of the sheets are fixed in the first fixing zone 45*a* and the toner image printed on the upper face of the sheet is fixed in the second fixing zone 46*a*.

Thus, there result the following advantages:

Simplex printing in which a sheet is printed on its one side and duplex printing in which a sheet is printed on both sides can selectively be performed.

Turning over a sheet for duplex printing makes it unnecessary to have recourse to two printing units for printing on front side and for printing on back side, respectively, and to increase the area for installation therefor.

Without requiring to increase the area for installation, the machine can be installed in a compact space.

The ability to perform duplex printing with a simplex printing unit permits reducing the cost of equipment.

Turning over a sheet printed on one side followed by transporting the sheet again onto an impression cylinder 31 in an electrophotographic printing section 30 makes it unnecessary to reset the one-side printed sheet in a sheet supply 10, thereby reducing the time period for duplex printing.

Using electrophotographic printing units 33 allows multicolor printing of both front and back sides of a sheet of paper.

It is also possible to print a sheet on both front and back sides in different images in a plurality of colors.

Also, by permitting a sheet printed on one side to be turned over in a sheet turnover transport unit 60 and the sheet turned over to fall on and thereby to be fed again onto a sheet transport conveyer 20 and then to be transported by the sheet transport conveyer 20 again onto the impression cylinder 31 and a toner image to be transferred on the other side, thus having both sides printed, the sheet printed on the one side is prevented from breaking or bending to damage while it is being turned over from the front to back and transported again onto the impression cylinder 31.

Mention is next made of specific details of the structural components.

Figure 2:
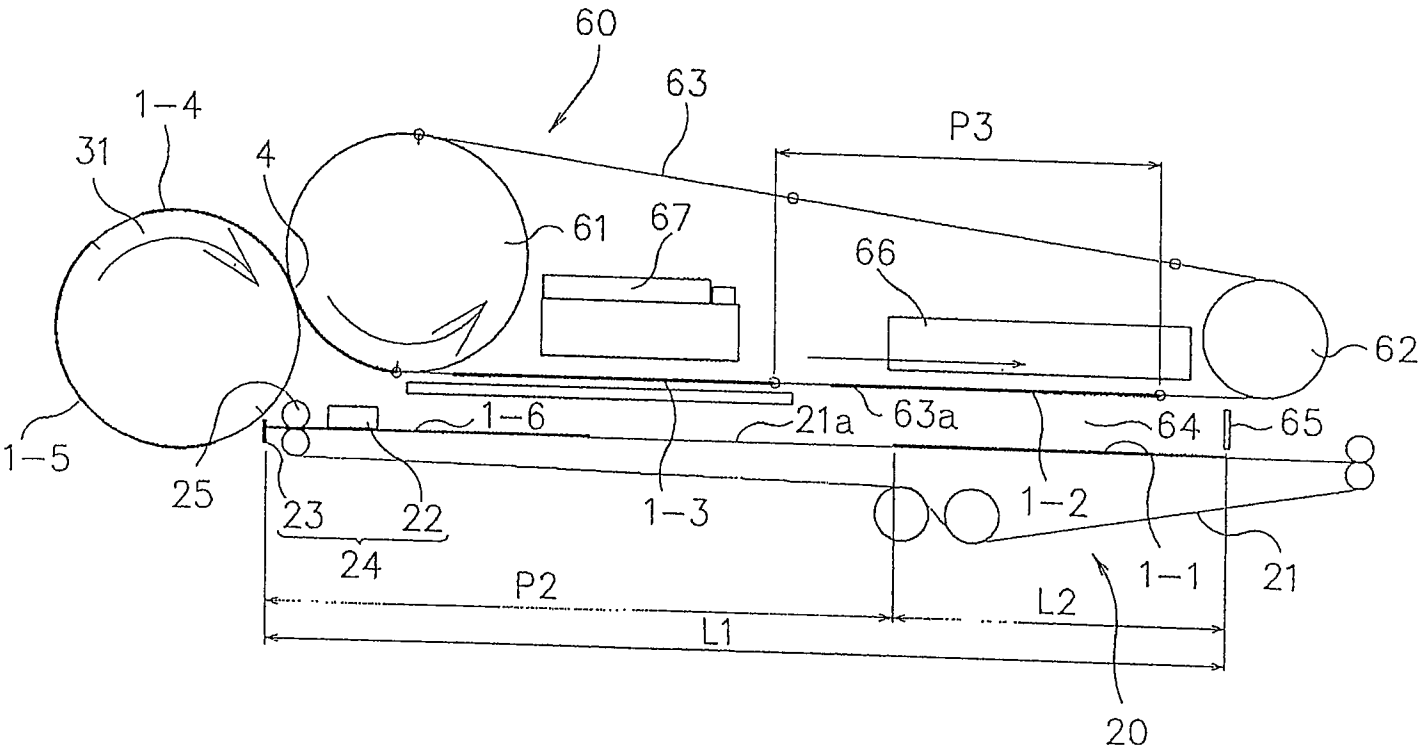
FIG. 2 is an enlarged view that illustrates a sheet transport conveyer and a sheet turnover transport unit as a part of that form of implementation of the invention.

As shown in FIG. 2, the impression cylinder 31 is rotated at a fixed peripheral speed.

The sheet transport conveyer 20 is driven on the basis of rotation of the impression cylinder 31.

Sheets are fed out from the sheet supply 10 at a rate of one sheet per one pitch and a rotation of the impression cylinder 31 corresponds to two (2) pitches. One (1) pitch here represents a distance of movement of a sheet on the sheet transport conveyer 20 when the impression cylinder 31 rotates by 180°.

A sheet transported on the sheet transport conveyer 20 is once stopped when it comes into contact with the front stopper 23 of the sheet positioner 24 in the state that the press roller 25 is moved up and apart from the sheet transport conveyer 20, the front stopper 23 positioning the sheet in a longitudinal direction. Then, the sheet is positioned in a crosswise direction by a crosswise slide 22 of the sheet positioner 24.

For this reason, the sheet transport conveyer 20 in course of 1 pitch is driven to travel at a variable speed between a low speed (V min) and a high speed (V max).

For example, in the case of front (one-side) printing, the sheet conveyer 20 is decelerated from the high speed as the sheet comes close to the front stopper 23, and travels at the low speed when it is in contact with the front stopper 23, thereby to effect positioning at the low speed. Then, the sheet transport conveyer 20 comes in a state of slipping with respect to the sheet.

After the sheet is positioned, the front stopper 23 is moved away from the sheet and the press roller 25 is brought into pressure contact with the sheet to feed out the sheet towards the impression cylinder 31. The sheet transport conveyer 20 is accelerated up to the peripheral speed of the impression cylinder 31 and, when its speed is equal to the peripheral speed of the impression cylinder 31, lets the sheet be gripped by a sheet gripper (not shown) provided for the impression cylinder 31. Thereafter, the sheet transport conveyer 20 is driven to travel at the high speed.

When the sheet is gripped by the sheet gripper of the impression cylinder 31, the press roller 25 is moved up and away from the sheet, preventing the sheet from being loaded with a tension from the impression cylinder 31. To with, the press roll 25, which if held in pressure contact with the sheet is applying a resistance to and loading a tension on the sheet, is moved away from the sheet so that no such tension is loaded on the sheet.

In effect, as shown in FIG. 3 the speed of the sheet transport conveyer 20 in the case of one-side printing when the sheet comes close to the sheet positioner 24 is decelerated from a high speed (V max 1, V max 2) to a low speed (V min) that is lower than a peripheral speed (V1, V2) of the impression cylinder 31. After the sheet is positioned, the speed of the sheet transport conveyer 20 is accelerated from the low speed (V min) to the high speed (V max 1, V max 2).

Note here that the high speed (V max 2) when the peripheral speed of the impression cylinder 31 is high (V2) is higher than the high speed (V max 1) when the peripheral speed of the impression cylinder is low (V1).

Bringing the sheet into contact with the front stopper 23 while decelerating the speed of the sheet transport conveyer 20 to a speed lower than the peripheral speed of the impression cylinder 31 in this manner facilitates positioning the sheet.

And, transporting the sheet while accelerating the sheet transport conveyer 20 to a speed higher than a peripheral speed of the impression cylinder 31 allows feeding out the sheet in matched timing with a rotation of the impression cylinder 31.

For two-side or duplex printing, a sheet printed on its front side is delivered in the second sheet delivery region 4 into the sheet turnover transport unit 60 in which it is transported on the lower part 63*a* of the chain 63 towards the sheet supply 10.

Grip of the sheet by the sheet gripper on the chain 63 is released by the sheet releasing mechanism 66. The one-side printed sheet upon contacting the sheet stopper 65 is allowed through the sheet falling region 65 to fall on and thereby to be supplied onto the upper part 21*a* of the conveyer belt 21 of the sheet transport conveyer 20 in the state that the sheet is turned over with the printed side facing upwards.

The sheet stopper 65 is made movable in the sheet transport direction and its position is adjusted according to a longitudinal length of the one-side printed sheet so that such sheets may fall at a same position in the sheet transport direction on the upper part of the sheet transport conveyer 20 (the upper part 21*a* of the endless belt 21) and may thereby be supplied thereon.

For example, for a sheet whose longitudinal length is longer, the sheet stopper 65 is positioned closer to the sheet supply 10. For a sheet which is shorter in its longitudinal length, the sheet stopper 65 is displaced towards the impression cylinder 31.

The position at which the sheet is released from the sheet gripper on the chain 63 can be altered by the sheet releasing mechanism 66.

The one-side printed sheet falling and supplied onto the sheet transport conveyer 20 is transported by the sheet transport conveyer 20 towards the impression cylinder 31, and its end comes in contact with the front stopper 23.

Then, the trailing end of a sheet when its front side is printed is turned to the leading end of the sheet when its back side is printed.

And, the sheet is positioned by the sheet positioner 24 and the sheet positioned is fed out onto the impression cylinder 31.

There are then determined the pull-in timing of the front stopper 23 in the sheet positioner 24 and the timing of pressure contact of the press roller 25, in matching with rotation of the impression cylinder 31.

Sheets fall in a time that is identical independently of a peripheral speed of the impression cylinder 31. The sheet transport conveyer 20 is driven to travel at a variable speed that is varied to follow a peripheral speed of the impression cylinder 31 as mentioned previously. Since there is then a time in which one-side printed sheets are not transported, a further high speed (V max 3) as shown in FIG. 4 is provided that is higher than the high speed (V max 1) in the case of one-side printing.

Even for an identical longitudinal length of sheets, note further that the faster the peripheral speed of the impression cylinder 31, the greater become the acceleration and deceleration of the speed of the sheet transport conveyer 20. To with, the high speed (V max) is made faster.

Pitch as mentioned above represents distance of movement P of a sheet effected by the sheet transport conveyer 20 while the impression cylinder 31 is rotated by 180°. Assuming P1 to be such distance of movement of a sheet when the sheet is printed on one side as shown in FIGS. 5 and P2 to be such distance of movement of a sheet when the sheet is printed on both sides as shown in FIG. 2, P2 is here set longer than P1.

Figure 5:
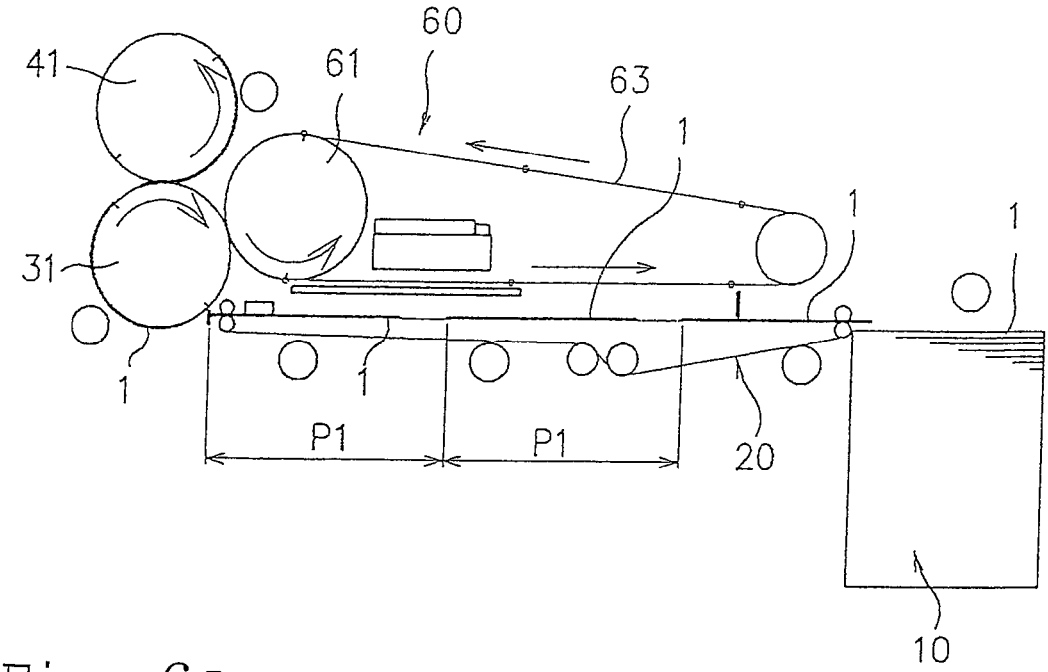
FIG. 5 is an explanatory view of an operation of one-side printing.

To with, in the case of one-side printing as shown in FIG. 5, a sheet may be transported according to the peripheral speed of the impression cylinder 31. Distance of movement P1 effected while the impression cylinder 31 is rotated by 180° can be made short. In the case of both-side printing, distance of movement P2 as shown in FIG. 2 is made longer than P1 (P1<P2) by a distance corresponding to a time it takes for the one-side printed sheet to fall from the sheet turnover transport unit 60 onto the sheet transport conveyer 20 so that the one-side printed sheet may not overlap in the sheet transport direction with a sheet fed out from the sheet supply 10.

In this form of implementation, duplex printing is performed iteratively for a plurality of sheets by repeating a continuous cycle of successively feeding sheets out of the sheet supply 10, simplex printing successively for their one sides and simplex printing successively for their other and remaining sides.

This allows a plurality of sheets to constantly exist for duplex printing in the path of sheet transport, making it possible to effect duplicate printing efficiently.

For example, in a sheet feed path for duplex printing as shown in FIG. 2 there are arranged six sheets, i.e. a first sheet 1-1 (printed on one side) on the upper part of the sheet transport conveyer 20, a sixth sheet 1-6 spaced from the first sheet in the sheet transport direction, a fifth sheet 1-5 on the impression cylinder 31, a fourth sheet 1-4 (printed on one side) over the impression cylinder 31 and the return intermediate cylinder 61, and a third and a second sheet 1-3 and 1-2 (both printed on one side) on the lower part of the chain 63 in the sheet turnover transport unit 60. The sheet transport path is thus utilized effectively, making it possible to perform duple printing efficiently.

Mention is next made of an example of duplex printing operation for every six sheets.

As shown in FIG. 2, let it be assumed that a distance of movement of a sheet by the sheet transport conveyer 20 and a distance of movement of a sheet by the sheet turnover transport unit 60 while the impression cylinder 31 is rotated by 180° are P2 and P3, respectively.

Distance L1 between the front stopper 23 and the sheet stopper 65 is longitudinal length L2 of a sheet plus P2 (L2<P2).

Here, peripheral length of each of the impression cylinder 31 and the return intermediate cylinder 61 is made longer than twice the length L2 of a sheet to reserve a space for the sheet gripper.

The sum of the length of the upper part 21*a* of the endless belt conveyer 21 in the sheet transport conveyer 20, the peripheral length of the impression cylinder 31, the peripheral length of the return intermediate cylinder 61 and the length of the lower part 63*a* of the chain 63 in the sheet turnover transport unit 60 is made longer than the sum of the longitudinal lengths of the first to sixth sheets 1-1~1-6.

The sheet supply 10 feeds out (supply) six (6) sheets continuously, as one sheet for 180° (½) rotation of the impression cylinder 31 and the six sheets for three (3) rotations of the impression cylinder 31.

After feeding out the sixth sheet 1-6, the sheet supply 10 suspends feeding out. Thereafter, the sheet supply 10 resumes feeding out six sheets after the impression cylinder 31 has had three rotations.

To with, the sheet supply 10 feeds out sheets for six pitches and suspends feeding out for six pitches, repeatedly. Thus, the sheet supply 10 for twelve (12) pitches feeds out six (6) sheets, i.e. the first to sixth sheets 1-1, 1-2, 1-3, 1-4, 1-5 and 1-6.

Figure 6A:
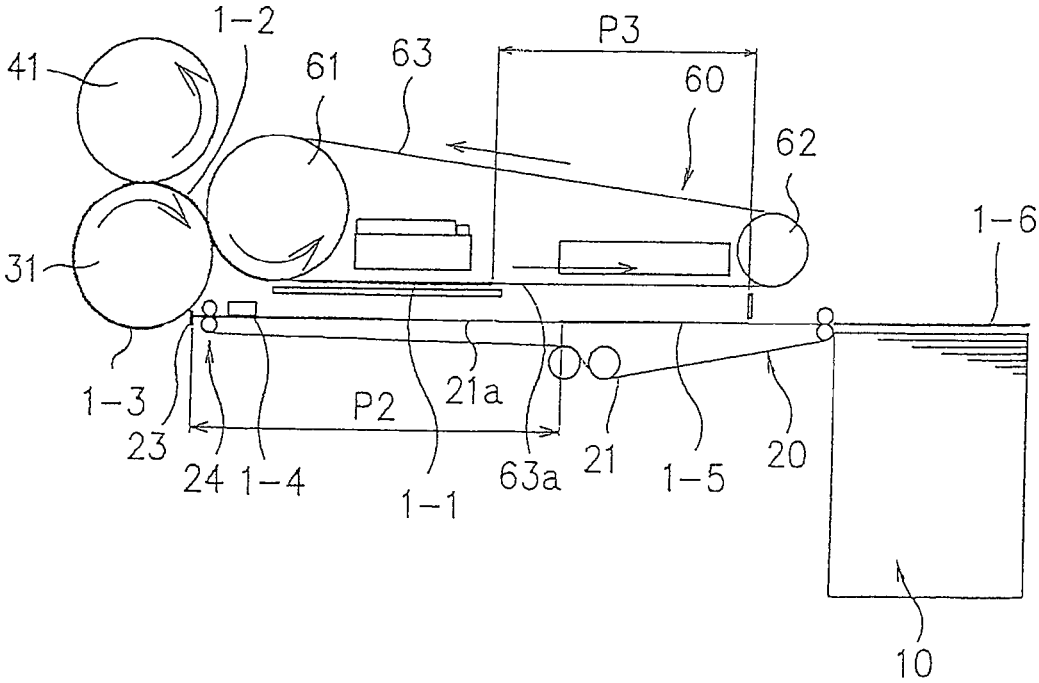
FIGS. 6A to 6I are explanatory views of operations of both-side printing.

When the sixth sheet 1-6 as shown in FIG. 6A is in a feed-out standby state in the sheet supply 10, each of the first and second sheets 1-1 and 1-2 has one side printed, the first sheet 1-1 being positioned on the lower part 63*a* of the chain 63 in the sheet turnover transport unit 60 and closer to the return intermediate cylinder 61, the second sheet 1-2 lying over and in contact with the impression cylinder 31 and the return intermediate cylinder 61.

The third sheet 1-3 is in contact with the impression cylinder 31 and is being printed on one side. The fourth sheet 1-4 is in contact with the front stopper 23 in the sheet positioner 24. The fifth sheet 1-5 is positioned on the sheet transport conveyer 20 and closer to the sheet supply 10 and has its front end coincident to the rear end of the distance of movement (pitch) P2.

Figure 6B:
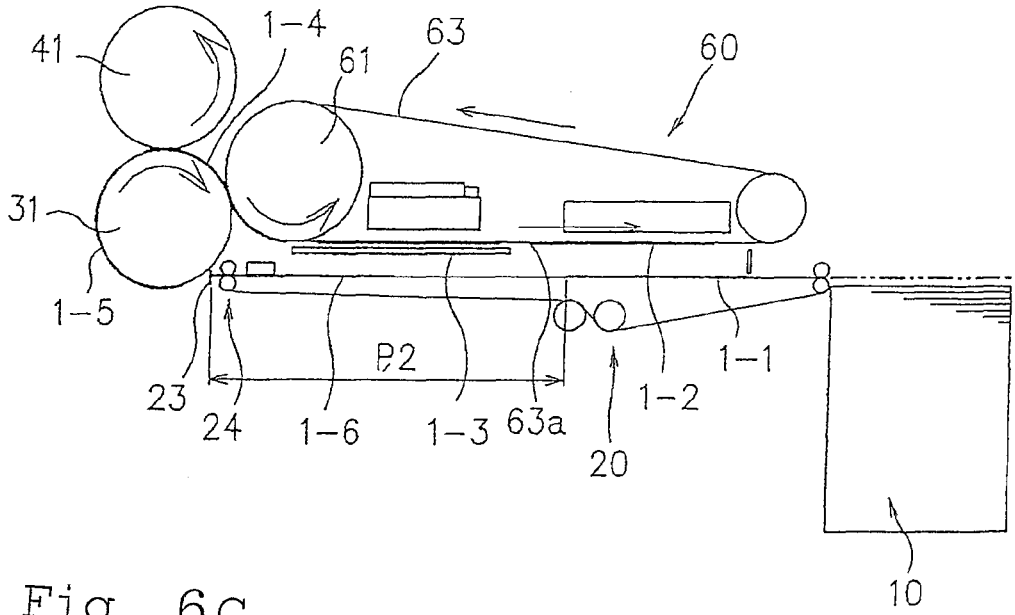

As shown in FIG. 6B, when the sixth sheet 1-6 comes in contact with the front stopper 23 in the sheet positioner 24, the first sheet 1-1 having one side printed has fallen and been supplied on the sheet transport conveyer 20 closer to the sheet supply 10.

Then, the first sheet 1-1 has been turned over, having the printed side facing upwards.

The second and third sheets 1-2 and 1-3 each having one side printed are positioned on the lower part 63*a* of the chain 63 in the sheet turnover transport unit 60. In other words, the distance of movement P3 is made shorter than one half of the total length of the lower part 63*a* of the chain 63 so that two sheets spaced from each other in the sheet transport direction may be retained on the lower part 63*a* of the chain 63.

The forth sheet 1-4 having one side printed lies in contact with and over the impression cylinder 31 and the return intermediate cylinder 61.

The fifth sheet 1-5 is in contact with the impression cylinder 31 and is being printed. The sixth sheet 1-6 is in contact with the front stopper 23 in the sheet positioner 24.

Figure 6C:
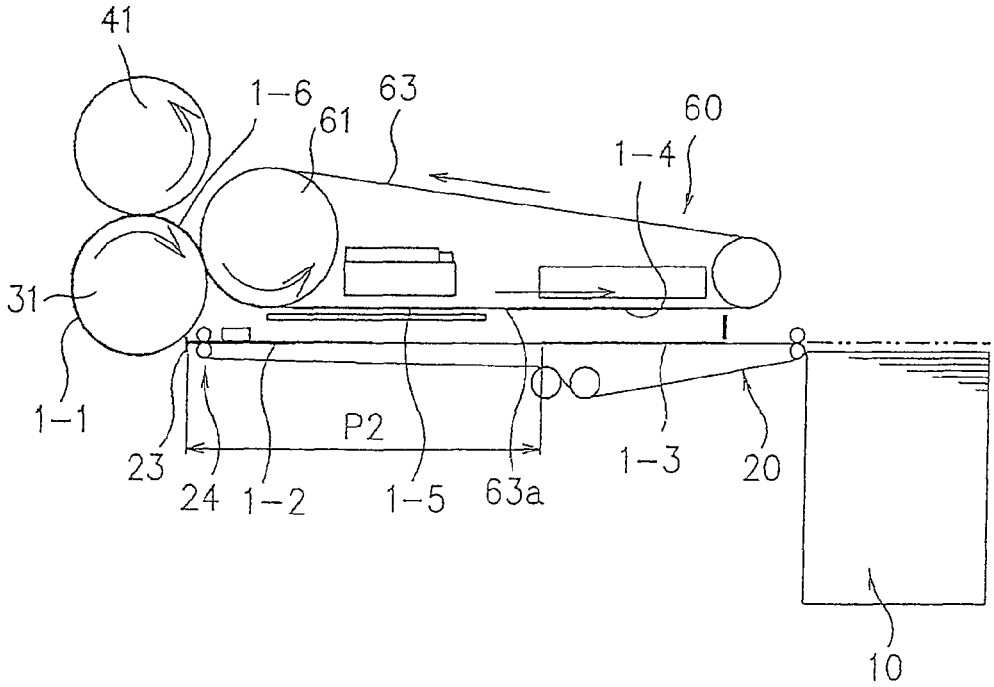

Thus, the first sheet 1-1 having one side printed can upon falling be supplied onto the sheet transport conveyer 20 upstream of, and without overlapping with, the sixth sheet 1-6 in the sheet transport direction The first to six sheets 1-1~1-6 are successively printed on their front sides. And, as shown in FIG. 6C, when the sixth sheet 1-6 is printed on the front side, the first sheet 1-1 having its front side printed has been fed onto the impression cylinder 31 and is there printed on its back side, constituting a duplex print sheet.

Then, the second sheet 1-2 having its front surface printed is in contact with the front stopper 23, and the third sheet 1-3 having its front side printed falls on the sheet transport conveyer 20 closer to the sheet supply 10 in the state that it is tuned over front to back.

The fourth and fifth sheets 1-4 and 1-5 each having the front side printed are arranged on the lower part 63 of the chain 63.

The sixth sheet 1-6 having the front side printed lies in contact with and over the impression cylinder 31 and the return intermediate cylinder 61.

Figure 6D:
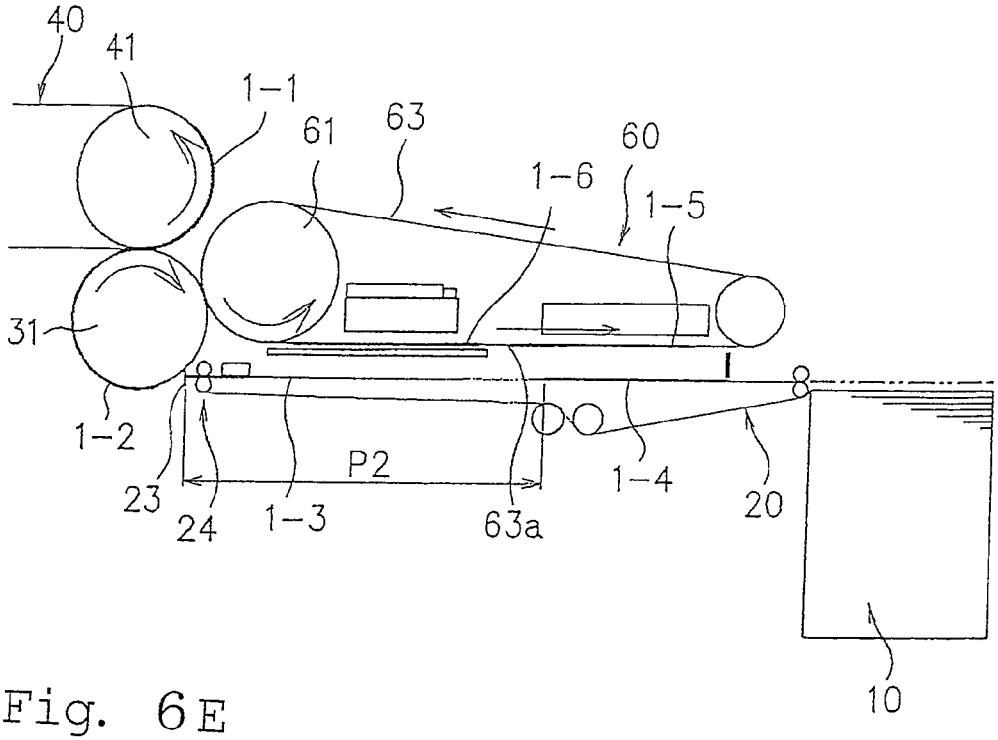

Subsequently, as shown in FIG. 6D the first sheet having both sides printed is delivered onto the transfer cylinder 41 to be transported to the print output receptacle 50 by the printed-sheet transport unit 40 in which to undergoes fixing operations of the front and back sides through the first and second fixing zones 45*a* and 46*a*, respectively, before such sheets are received one by one and piled in the receptacle 50.

Then, as shown in FIG. 6D the second sheet 1-2 printed on the front side has the front side in contact with the impression cylinder 31 and is printed on the back side. The third sheet 1-3 is contact with the front stopper 23 in the sheet positioner 24, the fourth sheet 1-4 falls on and is supplied onto the sheet transport conveyer 29 and the fifth and sixth sheets 1-5 and 1-6 are arranged on the lower part 63*a* of the chain 63 in the sheet turnover transport unit 60.

Figure 6E:
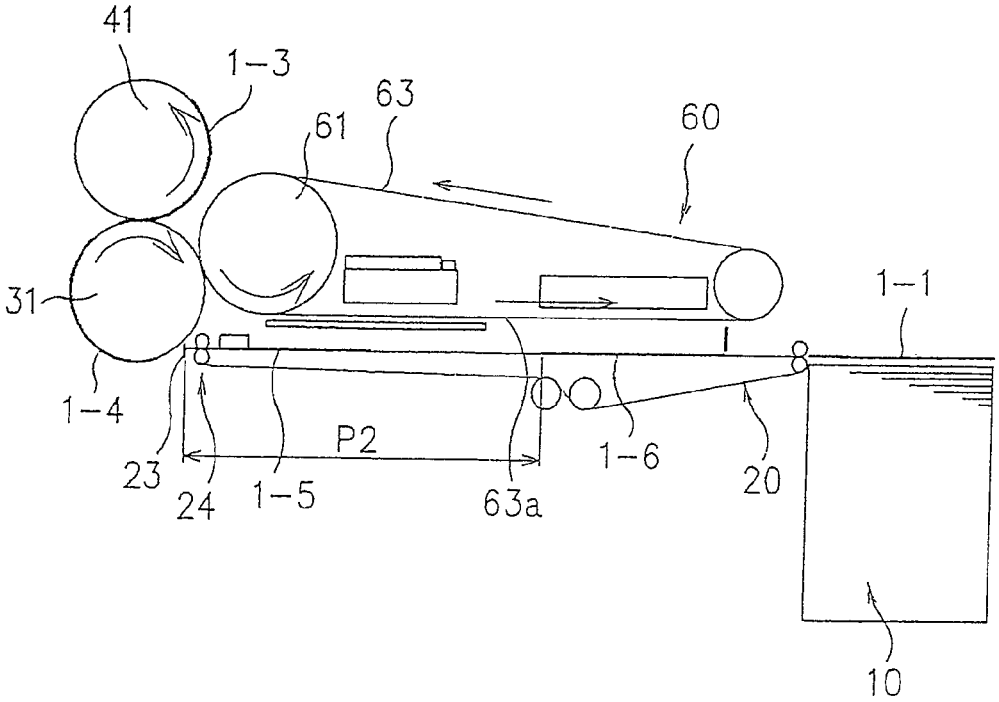

The first sheet 1-1, second sheet 1-2, third sheet 1-3 and fourth sheet 1-4 are printed each on both sides as mentioned previously and as shown in FIG. 6E the fifth sheet 1-5 having one side printed is fed out onto the impression cylinder 31 and the six sheet 1-6 having one side printed is initiated to move towards the sheet positioner 25 and at the same time a blank sheet as the first sheet 1-1 in a next cycle is being fed out of the sheet supply 10.

Figure 6F:
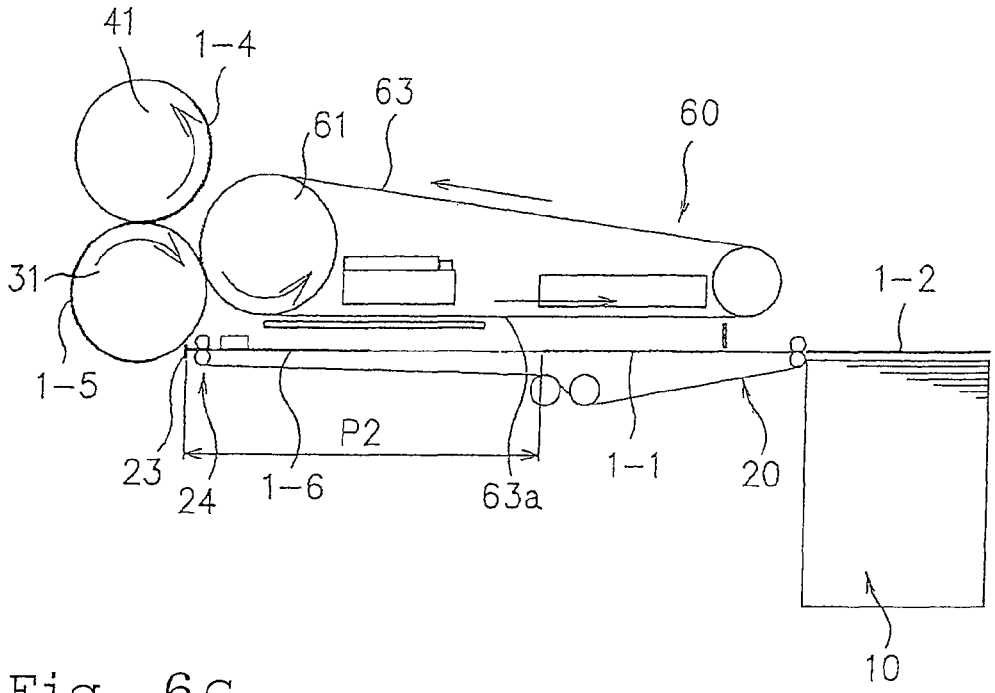

And, as shown in FIG. 6F, when the sixth sheet 1-6 having one side printed comes in contact with the front stopper 23 in the sheet positioner 24, the blank, first sheet 1-1 is positioned on the sheet transport conveyer 20 closer to the sheet supply 10. Then, no sheet exists on the lower part 63*a* of the chain 63 in the sheet turnover transport unit 60.

Figure 6G:
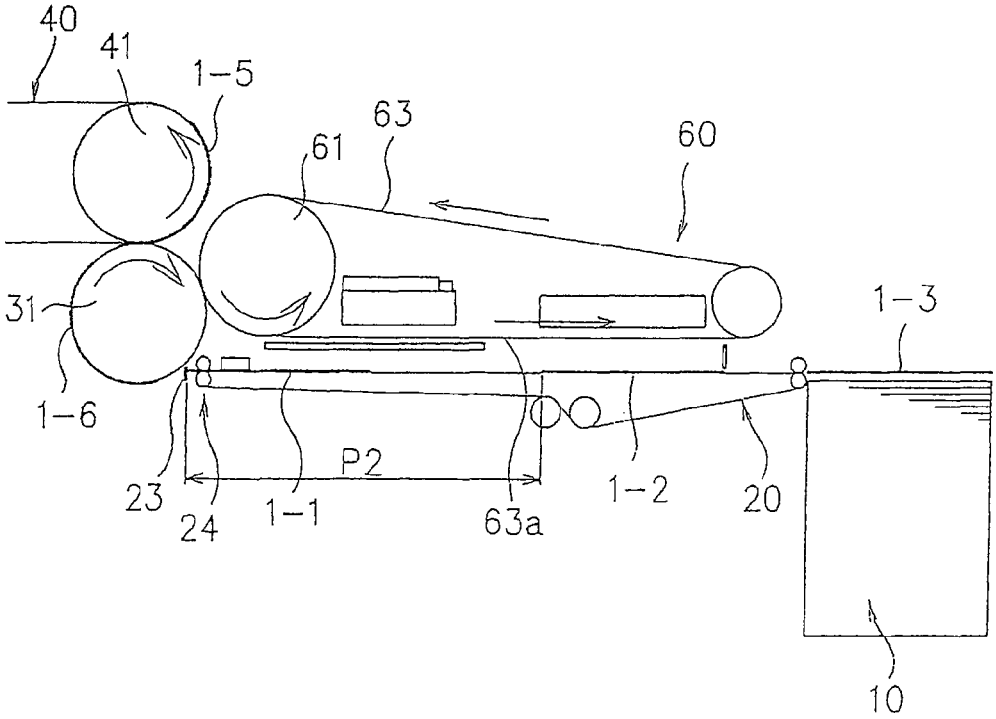

Subsequently, as shown in FIG. 6G, the fifth sheet 1-5 having both sides printed is delivered onto the printed sheet transport unit 40 and the sixth sheet 1-6 having one side printed is fed onto the impression cylinder 31 while the first blank sheet 1-1 is allowed to come in contact with the front stopper 23 and a second blank sheet 1-2 from the sheet supply 10 is fed out onto the sheet transport conveyer 20.

Figure 6H:
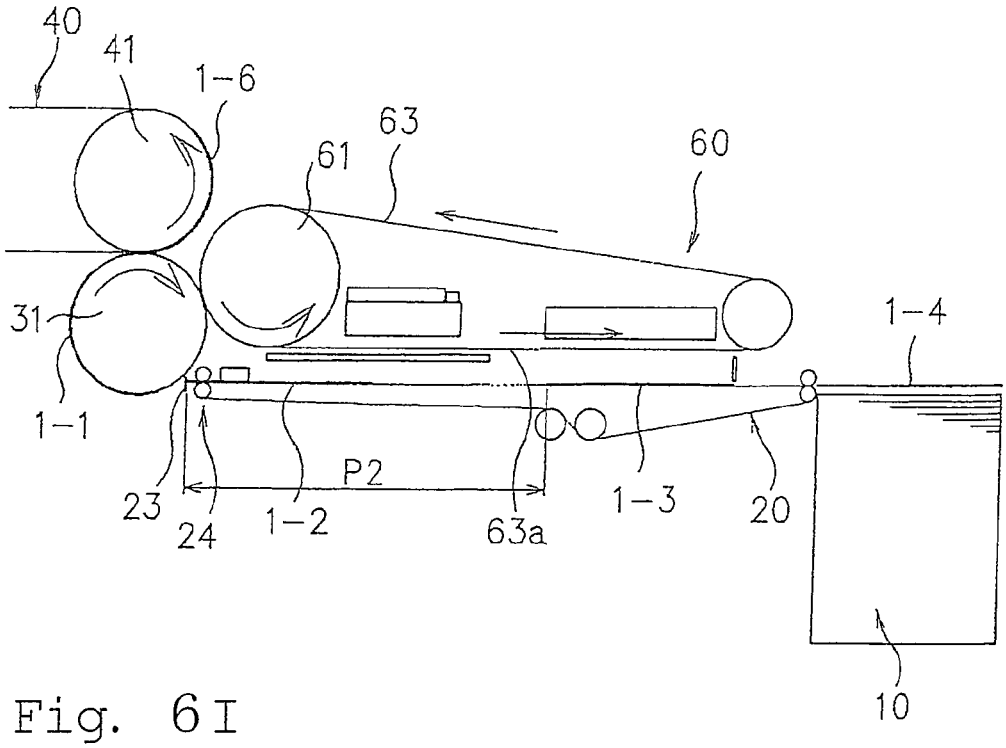

As shown in FIG. 6H, the sixth sheet 1-6 having both sides printed is delivered onto the printed-sheet transport unit 40, the first blank sheet 1-1 is fed out onto the impression cylinder 31 and printed on one side, the second blank sheet 1-2 is allowed to contact with the front stopper 23, and a third blank sheet 1-3 from the sheet supply 10 is fed out onto the sheet transport conveyer 20.

Figure 6I:
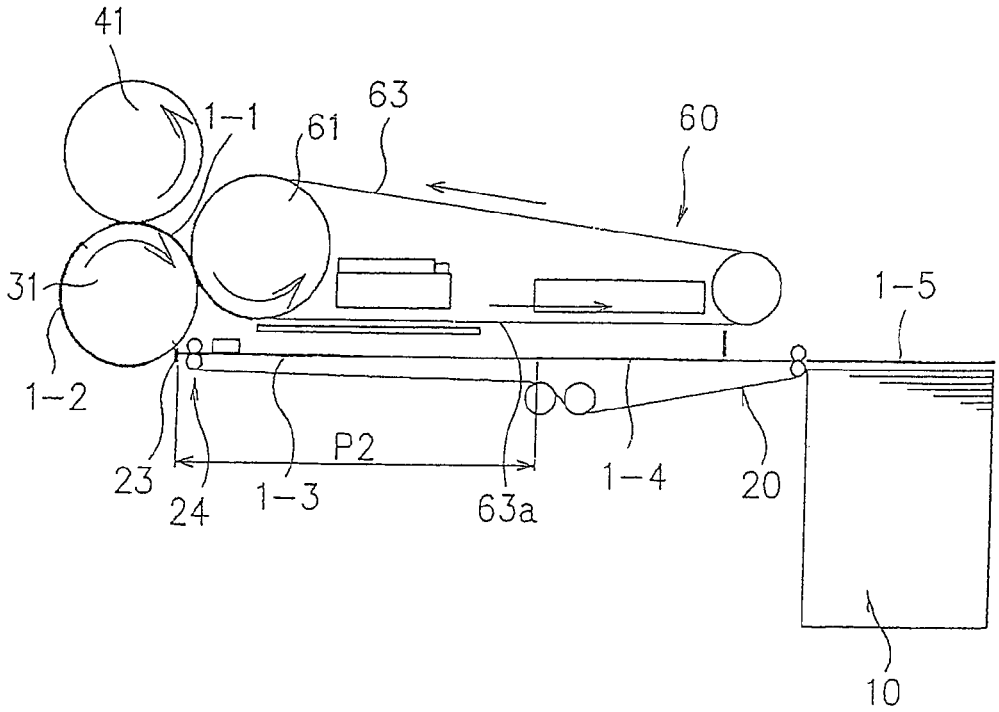

As shown in FIG. 6I, the first sheet 1-1 having one side printed is delivered onto the return intermediate cylinder 61, the blank, second sheet 1-2 is fed out onto the impression cylinder 31 and a fourth blank sheet 1-4 from the sheet supply 10 is fed out onto the sheet transport conveyer 20.

Thereafter, the present printing machine operates as shown in FIG. 6A.

In summarizing the foregoing duplex printing operation, six sheets 1-1~1-6 are duplex printed in one cycle of twelve pitches corresponding to six rotations of the impression cylinder 31. The sheet turnover transport unit 60 supplies the 1st sheet 1-1 printed on one side, by letting it fall, onto the sheet transport conveyer 20 in the 7th pitch of 12 pitches, in turn supplies the 2nd sheet 1-2 printed on one side, by letting it fall, onto the conveyer 20 in the 8th pitch of 12 pitches, supplies the 3rd sheet 1-3 printed on one side, by letting it fall, onto the conveyer 20 in the 9th pitch of 12 pitches, supplies the 4th sheet 1-4 printed on one side, by letting it fall, onto the conveyer 20 in the 10th pitch of 12 pitches, supplies the 5th sheet 1-5 printed on one side, by letting it fall, onto the conveyer 20 in the 11th pitch of 12 pitches, and supplies the 6th sheet 1-6 printed on one side, by letting it fall, onto the conveyer 20 in the 12th pitch of 12 pitches.

The sheet turnover transport unit 60 which need not to operate in one-side printing is equipped with a switchover means to cease its operation then.

The number of sheets for a duplex printing cycle need not be limited to six and may be five or less or seven or more.

Use of seven or more sheets for one duplex printing cycle requires the sheet transport conveyer 20 and the sheet turnover transport unit 60 to be made longer in transport length.

In duplex printing with a plurality of sheets as needed, it is preferable that the length in transport direction of the sheet transport section of the sheet transport conveyer 20 (its upper part) be longer than the sum of distance of movement P2 of a sheet for 180° rotation of the impression cylinder 31 and longitudinal length of a sheet and that there be provided a first space in which a sheet coming in contact with the font stopper 23 is held to wait to be fed out onto the impression cylinder 31 and a second space in which to receive a sheet falling and being supplied so that the sheet that has fallen may not overlap with the waiting sheet.

The sheet turnover transport unit 60 preferably has its (lower part) length in transport direction that is longer than twice the distance of movement P3 of a sheet while the impression cylinder 31 is rotated by 180°.

While sheets have been shown each printed for a 180° rotation of the impression cylinder 31, it is noted that the sheets may each be printed for an angle (360°/integer) such as 120° or 90° of rotation of the impression cylinder 31, in which the angle of rotation may be varied by changing its diameter.

Also, while the printed-sheet transport unit 40 and the sheet turnover transport unit 60 each of which transports a sheet supported not to fall by its own weight have been shown each as a chain having a sheet gripper, they may not be limited thereto. For example, they may each be of a combination of a perforated belt and a vacuum suction mechanism.

As noted further, they may each be an ordinary conveyer if it is one that can transport a sheet in the state that it may not fall by its own gravity.

Figure 7:
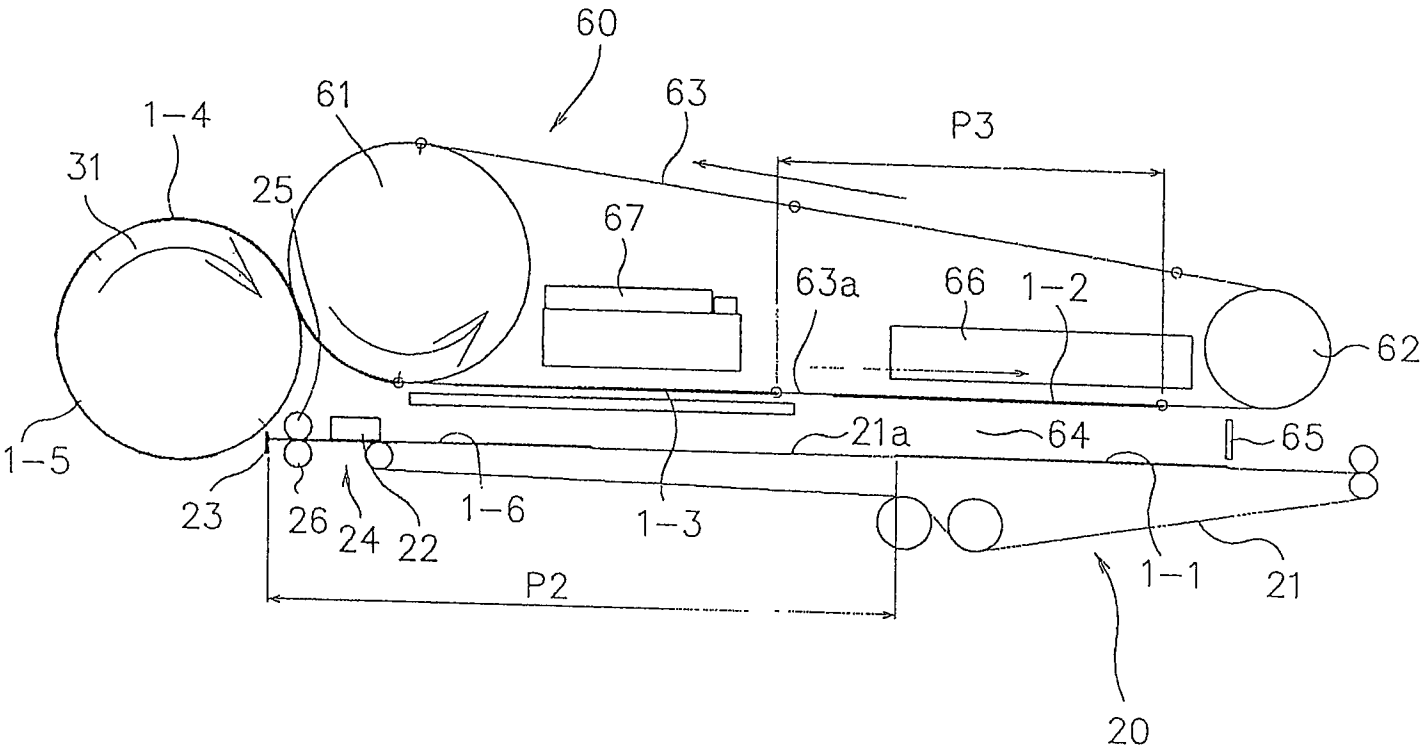
FIG. 7 is an explanatory view that illustrates an alternative embodiment of the sheet transport conveyer.

FIG. 7 shows an alternative embodiment of the sheet transport conveyer 20 in a sheet front/back printing machine according to the present invention.

In this embodiment, the sheet feed-out means comprises a press roll 25 disposed closer to the impression cylinder 31 than the endless belt 21 and a feed-out roller 26 driven to rotate, the press roll 25 being brought into pressure contact with and away from the feed-out roller 26.

In this embodiment, a sheet positioned by the feed-out roller 26 and the press roll 25 is fed out onto the impression cylinder 31. The sheet transport conveyer 20 here designed not to so feed out can be made to perform an operation different than by the feed-out roller.

What is claimed is:

1. An electrophotographic sheet-fed front/back printing machine comprising:

a sheet supply, a sheet transport conveyer, an electrophotographic printing section, a printed-sheet transport unit, a print output section, arranged in order from upstream to downstream in a direction of transport of sheets of paper, and a sheet turnover transport unit disposed upwards of the sheet transport conveyer, wherein:

said sheet supply feeds out sheets one by one onto the sheet transport conveyer, said sheet transport conveyer feeds out the sheets onto an impression cylinder in the electrophotographic printing section, said electrophotographic printing section comprises an electrophotographic printing unit including a photoconductor drum, a transfer roller and said impression cylinder, whereby a toner image formed on the photoconductor drum is transferred onto the transfer roller and the toner image on the transfer roller is transferred and printed onto a sheet on the impression cylinder, said printed-sheet transport unit receives a printed sheet delivered from said impression cylinder for transporting the printed sheet to said print output section, said sheet turnover transport unit receives a printed sheet delivered from said impression cylinder for turning over the printed sheet from front to back and allowing it to fall and to be supplied onto said sheet transport conveyer, said electrophotographic sheet-fed front/back printing machine further comprises a sheet delivery region which selectively delivers a printed sheet from said impression cylinder to one of said printed-sheet transport unit and said sheet turnover transport unit, said sheet transport conveyer is provided on its sheet feed-out side with a sheet positioner for positioning a sheet longitudinally and crosswise and a sheet feed-out means for feeding out the so positioned sheet onto the impression cylinder, and said sheet transport conveyer has a traveling speed so controlled to follow a peripheral speed of the impression cylinder that it is slower than the peripheral speed of the impression cylinder when the sheet is positioned as aforesaid and that it is faster than the peripheral speed of the impression cylinder while the sheet is in transport.

2. The electrophotographic sheet-fed front/back printing machine as set forth in claim 1, wherein:

said impression cylinder is double the size of said photoconductor drum and is configured to have two sheets set thereon so that one of the two sheets comes into contact with said transfer roller and the other sheet comes into contact with a transfer cylinder for said printed-sheet transport unit and with a return intermediate cylinder in said sheet turnover transport unit, respectively.

3. The electrophotographic sheet-fed front/back printing machine as set forth in claim 1, wherein:

said sheet supply is operable to repeat an operation of feeding out a plurality of sheets successively and interrupting feeding out the sheets, said sheet delivery region has a first state of delivering a printed sheet onto said sheet turnover transport unit in which a plurality of sheets fed out of said sheet supply are each printed on one side, and a second state of delivering a printed sheet to said printed-sheet transport unit, said sheet delivery region is in said second state when a first of the sheets each printed on one side and fed onto the impression cylinder is also printed on the other side, and said sheet delivery region resumes said first state when a last of the sheets fed out of the sheet supply and each having both sides printed is delivered to said printed-sheet transport unit.

4. The electrophotographic sheet-fed front/back printing machine as set forth in claim 3, wherein:

said sheet transport conveyer has a length of sheet transport such that a sheet positioned closer to and fed out onto said impression cylinder and a sheet falling and supplied from said sheet turnover transport unit and closer to said sheet supply may not overlap with each other, and said sheet turnover transport unit has a path of transport in which a printed sheet delivered from said impression cylinder is transported towards said sheet supply, said path having a sheet falling region in which the printed sheet transported is allowed to fall on said sheet transport conveyer and closer to said sheet supply.

5. The electrophotographic sheet-fed front/back printing machine as set forth in claim 3, wherein:

said impression cylinder is double the size of said photoconductor drum and is configured to have two sheets set thereon so that one of the two sheets comes into contact with said transfer roller and the other sheet comes into contact with a transfer cylinder for said printed-sheet transport unit and with a return intermediate cylinder in said sheet turnover transport unit, respectively.

6. The electrophotographic sheet-fed front/back printing machine as set forth in claim 4, wherein:

said impression cylinder is double the size of said photoconductor drum and is configured to have two sheets set thereon so that one of the two sheets comes into contact with said transfer roller and the other sheet comes into contact with a transfer cylinder for said printed-sheet transport unit and with a return intermediate cylinder in said sheet turnover transport unit, respectively.

7. An electrophotographic sheet-fed front/back printing machine comprising:

a sheet supply, a sheet transport conveyer, an electrophotographic printing section, a printed-sheet transport unit, a print output section, arranged in order from upstream to downstream in a direction of transport of sheets of paper, and a sheet turnover transport unit disposed upwards of the sheet transport conveyer, wherein:

said sheet supply feeds out sheets one by one onto the sheet transport conveyer, said sheet transport conveyer feeds out the sheets onto an impression cylinder in the electrophotographic printing section, said electrophotographic printing section comprises an electrophotographic printing unit including a photoconductor drum, a transfer roller and said impression cylinder, whereby a toner image formed on the photoconductor drum is transferred onto the transfer roller and the toner image on the transfer roller is transferred and printed onto a sheet on the impression cylinder, said printed-sheet transport unit receives a printed sheet delivered from said impression cylinder for transporting the printed sheet to said print output section, said sheet turnover transport unit receives a printed sheet delivered from said impression cylinder for turning over the printed sheet from front to back and allowing it to fall and to be supplied onto said sheet transport conveyer, said electrophotographic sheet-fed front/back printing machine further comprises a sheet delivery region which selectively delivers a printed sheet from said impression cylinder to one of said printed-sheet transport unit and said sheet turnover transport unit, and said impression cylinder is double the size of said photoconductor drum and is configured to have two sheets set thereon so that one of the two sheets comes into contact with said transfer roller and the other sheet comes into contact with a transfer cylinder for said printed-sheet transport unit and with a return intermediate cylinder in said sheet turnover transport unit, respectively.

8. An electrophotographic sheet-fed front/back printing machine comprising:

a sheet supply, a sheet transport conveyer, an electrophotographic printing section, a printed-sheet transport unit, a print output section, arranged in order from upstream to downstream in a direction of transport of sheets of paper, and a sheet turnover transport unit disposed upwards of the sheet transport conveyer, wherein:

said sheet supply feeds out sheets one by one onto the sheet transport conveyer, said sheet transport conveyer feeds out the sheets onto an impression cylinder in the electrophotographic printing section, said electrophotographic printing section comprises an electrophotographic printing unit including a photoconductor drum, a transfer roller and said impression cylinder, whereby a toner image formed on the photoconductor drum is transferred onto the transfer roller and the toner image on the transfer roller is transferred and printed onto a sheet on the impression cylinder, said printed-sheet transport unit receives a printed sheet delivered from said impression cylinder for transporting the printed sheet to said print output section, said sheet turnover transport unit receives a printed sheet delivered from said impression cylinder for turning over the printed sheet from front to back and allowing it to fall and to be supplied onto said sheet transport conveyer, said electrophotographic sheet-fed front/back printing machine further comprises a sheet delivery region which selectively delivers a printed sheet from said impression cylinder to one of said printed-sheet transport unit and said sheet turnover transport unit, said sheet supply is operable to repeat an operation of feeding out a plurality of sheets successively and interrupting feeding out the sheets, said sheet delivery region has a first state of delivering a printed sheet onto said sheet turnover transport unit in which a plurality of sheets fed out of said sheet supply are each printed on one side, and a second state of delivering a printed sheet to said printed-sheet transport unit, said sheet delivery region is in said second state when a first of the sheets each printed on one side and fed onto the impression cylinder is also printed on the other side, said sheet delivery region resumes said first state when a last of the sheets fed out of the sheet supply and each having both sides printed is delivered to said printed-sheet transport unit, and said impression cylinder is double the size of said photoconductor drum and is configured to have two sheets set thereon so that one of the two sheets comes into contact with said transfer roller and the other sheet comes into contact with a transfer cylinder for said printed-sheet transport unit and with a return intermediate cylinder in said sheet turnover transport unit, respectively.

9. The electrophotographic sheet-fed front/back printing machine comprising:

a sheet supply, a sheet transport conveyer, an electrophotographic printing section, a printed-sheet transport unit, a print output section, arranged in order from upstream to downstream in a direction of transport of sheets of paper, and a sheet turnover transport unit disposed upwards of the sheet transport conveyer, wherein:

said sheet supply feeds out sheets one by one onto the sheet transport conveyer, said sheet transport conveyer feeds out the sheets onto an impression cylinder in the electrophotographic printing section, said electrophotographic printing section comprises an electrophotographic printing unit including a photoconductor drum, a transfer roller and said impression cylinder, whereby a toner image formed on the photoconductor drum is transferred onto the transfer roller and the toner image on the transfer roller is transferred and printed onto a sheet on the impression cylinder, said printed-sheet transport unit receives a printed sheet delivered from said impression cylinder for transporting the printed sheet to said print output section, said sheet turnover transport unit receives a printed sheet delivered from said impression cylinder for turning over the printed sheet from front to back and allowing it to fall and to be supplied onto said sheet transport conveyer, said electrophotographic sheet-fed front/back printing machine further comprises a sheet delivery region which selectively delivers a printed sheet from said impression cylinder to one of said printed-sheet transport unit and said sheet turnover transport unit, said sheet supply is operable to repeat an operation of feeding out a plurality of sheets successively and interrupting feeding out the sheets, said sheet delivery region has a first state of delivering a printed sheet onto said sheet turnover transport unit in which a plurality of sheets fed out of said sheet supply are each printed on one side, and a second state of delivering a printed sheet to said printed-sheet transport unit, said sheet delivery region is in said second state when a first of the sheets each printed on one side and fed onto the impression cylinder is also printed on the other side, said sheet delivery region resumes said first state when a last of the sheets fed out of the sheet supply and each having both sides printed is delivered to said printed-sheet transport unit, said sheet transport conveyer has a length of sheet transport such that a sheet positioned closer to and fed out onto said impression cylinder and a sheet falling and supplied from said sheet turnover transport unit and closer to said sheet supply may not overlap with each other, said sheet turnover transport unit has a path of transport in which a printed sheet delivered from said impression cylinder is transported towards said sheet supply, said path having a sheet falling region in which the printed sheet transported is allowed to fall on said sheet transport conveyer and closer to said sheet supply, and said impression cylinder is double the size of said photoconductor drum and is configured to have two sheets set thereon so that one of the two sheets comes into contact with said transfer roller and the other sheet comes into contact with a transfer cylinder for said printed-sheet transport unit and with a return intermediate cylinder in said sheet turnover transport unit, respectively.

* * * * *